US009701145B2

(12) United States Patent
Chatow et al.

(10) Patent No.: US 9,701,145 B2
(45) Date of Patent: Jul. 11, 2017

(54) COVERT LABEL

(75) Inventors: Ehud Chatow, Palo Alto, CA (US); Galia Golodetz, Nes Zona (IL); Steven J. Simske, Fort Collins, CO (US); Gal Victor, Nes Zona (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 1750 days.

(21) Appl. No.: 11/799,444

(22) Filed: Apr. 30, 2007

(65) Prior Publication Data

US 2008/0268139 A1 Oct. 30, 2008

(51) Int. Cl.

| | |
|---|---|
| ***B41M 3/00*** | (2006.01) |
| ***B42D 15/02*** | (2006.01) |
| ***G09F 3/00*** | (2006.01) |

(52) U.S. Cl.

CPC ..... *B41M 3/005* (2013.01); *B42D 15/025* (2013.01); *G09F 3/0292* (2013.01); *Y10T 428/24802* (2015.01)

(58) Field of Classification Search

CPC ..... B42D 15/025

USPC ..... 283/72, 81, 94, 100–101, 107–108, 901, 283/903; 428/195.1, 201–203

See application file for complete search history.

(56) References Cited

U.S. PATENT DOCUMENTS

| | | | | |
|---|---|---|---|---|
| 4,082,873 | A * | 4/1978 | Williams | 428/42.1 |
| 4,718,553 | A * | 1/1988 | Adamoli et al. | 206/459.1 |
| 4,837,061 | A * | 6/1989 | Smits et al. | 283/108 |
| 5,633,058 | A * | 5/1997 | Hoffer et al. | 283/81 |
| 2003/0004889 | A1* | 1/2003 | Fiala et al. | 705/64 |
| 2006/0182955 | A1* | 8/2006 | Sellars | 428/354 |

* cited by examiner

*Primary Examiner* — Kyle Grabowski

(74) *Attorney, Agent, or Firm* — Wagner Blecher, LLP

(57) ABSTRACT

A covert label. A substrate comprises a field of ink. Disposed within the field of ink, is ink that can be preferentially removed according to a preconfigured pattern. The preconfigured pattern comprises information associable with at least one object.

16 Claims, 5 Drawing Sheets

COVERT LABEL

BACKGROUND

Producers and consumers of commercial goods are faced with a problem of counterfeit goods, or used goods that are packaged and sold, as if they were new. Counterfeiting and misrepresentation of a producer's product undermines a producers' reputation by having their name associated with substandard quality. A consumer is hurt by purchasing a substandard quality product. Both producer and consumer are hurt by loss of revenue and money.

BRIEF DESCRIPTION OF THE DRAWINGS

The accompanying drawings, which are incorporated in and form a part of this specification, illustrate embodiments of the invention and, together with the description, serve to explain the principles of the invention.

Figure 1A:
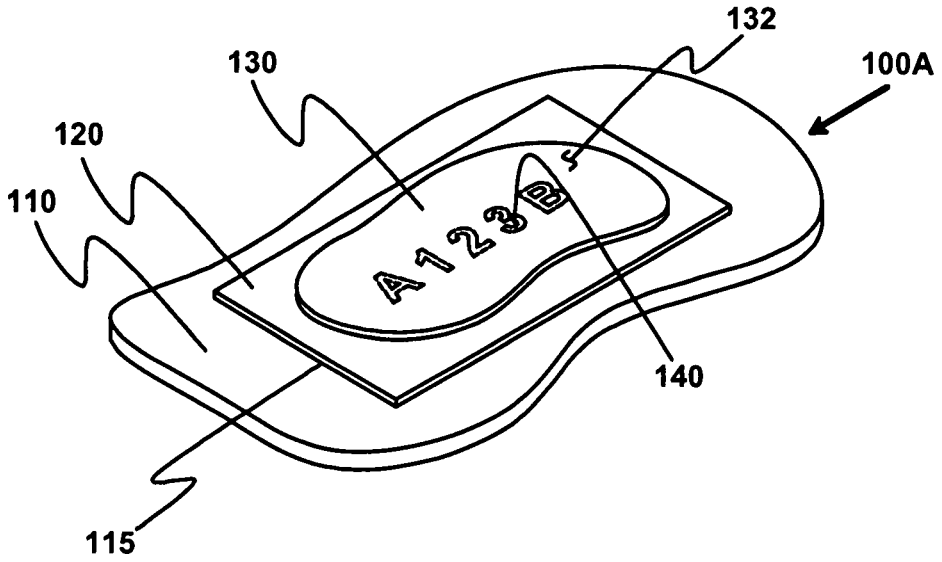
FIG. 1A is an isometric of a covert label, in accordance with an embodiment of the present invention.

The drawings referred to in this description should not be understood as being drawn to scale except if specifically noted.

DESCRIPTION OF THE EMBODIMENTS

Various embodiments of the present invention, a covert label, are described herein. A substrate comprises a field of ink. Disposed within the field of ink, is ink that can be preferentially removed according to a preconfigured pattern. The preconfigured pattern comprises information, which is capable of being associated with at least one object.

Reference will now be made in detail to the various embodiments of the invention, examples of which are illustrated in the accompanying drawings. While the invention will be described in conjunction with the various embodiments, it will be understood that they are not intended to limit the invention to these embodiments. On the contrary, embodiments of the invention are intended to cover alternatives, modifications and equivalents, which may be included within the spirit and scope of the invention as defined by the appended claims. Furthermore, in the following description of the various embodiments of the present invention, numerous specific details are set forth in order to provide a thorough understanding of embodiments of the present invention. In other instances, well known methods, procedures, and components have not been described in detail as not to unnecessarily obscure aspects of the embodiments of the present invention.

In one embodiment, a covert label is a label whose complete information is not revealed until the label is activated. If activation is required to make the object operable to which the label is attached, then activation of the label cannot be circumvented. If it is also desirable to activate the label, for instance to reveal an incentive such as a discount on a purchase or a lottery chance, the end-user of the object may be compelled to enter the information from the covert label into a database.

Embodiments of the present invention provide a covert label that is based upon printing a covert label with ink that has differential adhesion. Differential adhesion of ink may be obtained by using a variety of techniques known in the art. For example, one technique is to apply, to a substrate, ink that swells more than the ink that surrounds it, and thus have less adhesion for the ink that swells. Another technique well known in the art is to apply an adhesion promoter, or primer, to a substrate prior to applying an ink. By printing an adhesion promoter in a preconfigured pattern prior to applying the ink, the surrounding ink without the adhesion promoter can be removed from the substrate to reveal information contained in the preconfigured pattern. An example in contrast to this is to print a preconfigured pattern with an adhesion inhibitor that will allow the ink covering the adhesion inhibitor to be removed, thus revealing the information contained in the preconfigured pattern.

Embodiments of the present invention provide various revealing mechanisms by which the preconfigured pattern is irreversibly revealed upon activation of the revealing mechanism, which removes the differentially adhering ink. For example, by adhesively coupling the covert label to an object and removing the covert label from the object to which it is adhered leaves differentially adhering ink on the object and/or on the covert label. Another example is removing adhesive tape from the surface of the covert label, which may have been adhered to the covert label during packaging, and thusly leaves differentially adhering ink on the adhesive tape and/or on the covert label. Yet another example is a translucent membrane, such as adhesive tape, that is fabricated as part of the covert label, which upon removal, removes the differentially adhering ink from the surrounding ink.

Embodiments of the present invention also provide a method of implementing a covert label for tracking a preconfigured pattern to a database. Entry into a database of the information in a preconfigured pattern can be implemented through various means. For example, a package at point of sale to a customer can offer an in-store discount on the item being sold, by activating the previously described ink removal mechanism. Upon revealing the preconfigured pattern, the information contained in the preconfigured pattern can be entered into a database by the store clerk, for example by means of a machine reader such as a bar code scanner, or a character recognition system. Another example of entry into a database of information contained within a preconfigured pattern is, upon activation of an ink removal mechanism of a covert label of an object, instructions included with the object offer the end-user remuneration to visit the object producer's website and enter the information contained within the preconfigured pattern of the covert pattern.

Embodiments of the present invention benefit the producer of commercial goods. The information contained within a preconfigured pattern can be associated with an object of commercial goods and identify the object as being consumed by an end-user. Tracking commercial goods produced against commercial goods consumed can aid with forensic investigations into the loss or theft of commercial goods. The difficulty of subverting and the investment required to fabricate covert labels is a deterrent in any attempt to reuse objects comprising covert labels that are in accordance with embodiments of the present invention.

FIG. 1A is an isometric of a covert label 100A, in accordance with an embodiment of the present invention.

Covert label 100A comprises substrate 120 which comprises field of ink 130. In accordance with one embodiment of the present invention, substrate 120 is a freestanding, unattached substrate that is separate from object 110 that will use covert label 100A. In accordance with another embodiment, substrate 120 is object 110 that will use covert label 100A. For example, substrate 100A can be a prefabricated label that can be coupled to object 110, or substrate 100A can be object 110, such as a package, that is printed with covert label 100A. In the example of a freestanding covert label 100A, a coupling means, such as an adhesive is applied to interface 115 between object 110 and substrate 120.

In accordance with an embodiment of the present invention, field of ink 130 comprises an ink with differential adhesion. Differential adhesion allows one area of ink to adhere more tightly than another area of ink in field of ink 130. Ink with differential adhesion is operable to preferential removal. By applying ink with differential adhesion in preconfigured pattern 140, information can be covertly concealed within field of ink 130 until ink is preferentially removed. Field of ink 130 is printed with a uniform pattern, image, and/or color of ink. Only when the differentially adhering ink is removed, the information contained within preconfigured pattern 140 is revealed. Such information is capable of being associated with object 110.

There are various methods well known in the art for creating differential adhesion. For example, ink can be formulated to swell slightly upon application, thusly decreasing the adhesion of the ink. In accordance with an embodiment of the present invention, an adhesion promoter and/or an adhesion inhibitor can be printed onto substrate 120 in preconfigured pattern 140 prior to the application of field of ink 130. In accordance with an embodiment of the present invention, preconfigured pattern 140 can be printed in positive or negative image with differential adhesion. Preconfigured pattern 140 can be printed with ink having adhesion less than adhesion of the surrounding ink within field of ink 130. Preconfigured pattern 140 can be printed with ink having adhesion greater than adhesion of the surrounding ink within field of ink 130.

Figure 1B:
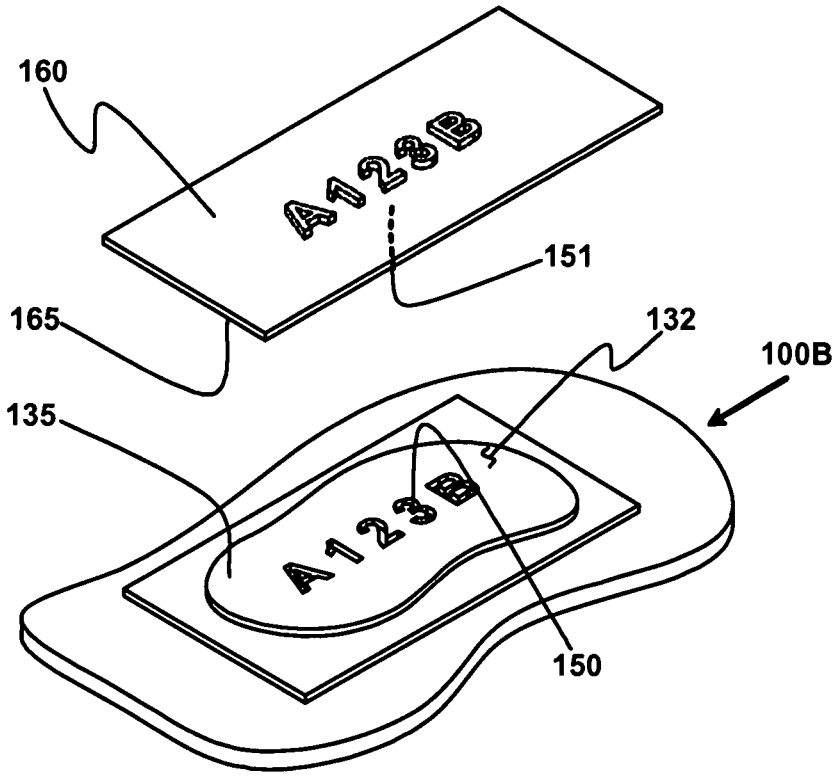
FIG. 1B is an isometric blow-apart of an overt label, in accordance with an embodiment of the present invention.

FIG. 1B is an isometric blow-apart of an overt label 100B during activation of a revealing mechanism, ink removal mechanism 160, thereby transforming covert label 100A into overt label 100B, in accordance with an embodiment of the present invention. Ink removal mechanism 160 has preferentially removed field of ink 130, thereby becoming information field 135. Information 150 is made visible in information field 135 and is made visible in reverse image information 151 on surface 165 of ink removal mechanism 160. In so doing, information 150 and reverse image information 151 have become irreversibly revealed.

In accordance with an embodiment of the present invention, information (150,151) is generated as mass serial numbers or random numbers that are associable to a tracking database which is associable to the item on which it will be coupled. In accordance with an embodiment of the present invention, information (150, 151) is linked to an overt identifier such as a bar code or machine readable character set which in turn is associable to a tracking database. A tracking database is capable of providing information on the item to which it is coupled. Examples of such information are: date of manufacturer; lot from which the item was produced; quantity in the lot; material from which the item was fabricated; and subcomponents used within the item. In accordance with another embodiment of the present invention, information (150,151) is associable to more than one item to which it is attached, such as a batch of items.

Ink removal mechanism 160 comprises an adhesive surface that couples with field of ink 130 on surface 132. In accordance with an embodiment of the present invention, ink removal mechanism 160 comprises an adhesive membrane such as an adhesive tape. Ink removal mechanism 160 is translucent and/or transparent to allow visibility of reverse image information 151 from both its surfaces once it has been activated from field of ink 130. By virtue of ink removal mechanism 160 being translucent and/or transparent, field of ink 130 is visible through ink removal mechanism 160. Visibility of information 150 and/or reverse image information 151, while ink removal mechanism 160 is adhered to field of ink 130, is an indication of possible tampering with covert label 100A.

In accordance with another embodiment of the present invention, covert label 100A comprising substrate 120, and field of ink 130, and is assembled to object 110 via surface 132. Assembly comprises adhesively coupling covert label 100A to object 110. Substrate 120 possesses translucent and/or transparent properties that allow visibility of field of ink 130 while covert label 100A is adhered to object 110 via surface 132. Upon removal of covert label 100A from object 110, object 110 becomes an ink removal mechanism. Activation of object 110 as an ink removal mechanism reveals information 150 in information field 135 and in reverse image information 151 on the surface of object 110 that had been adhered to surface 132.

In accordance with another embodiment of the present invention, ink removal mechanism 160 is coupled to covert label 100A upon assembly of object 110. As an example, object 110 is a package, and upon sealing object 110 with packaging tape, packaging tape is adhered to surface 132 thereby becoming ink removal mechanism 160.

Information (150, 151) is covertly printed in preconfigured pattern 140. In accordance with embodiments of the present invention, information (150, 151) is associated with object 110 on which it is coupled, wherein object 110 is a package or an end-user product. In accordance with embodiments of the present invention, information (150, 151) is associated with an end-user product inside a package to which it is coupled. Through the use of bar code and character reader systems, it is well known in the art how to cross-reference and associate information. For example, a bar code on an end-user product, such as an ink cartridge, is scanned into a data base as it is being packaged. As covert label 100A is being coupled to the package, a bar code which is associated with information (150, 151) and coupled to covert label 100A is scanned and associates the ink cartridge with covert label 100A.

Figure 2:
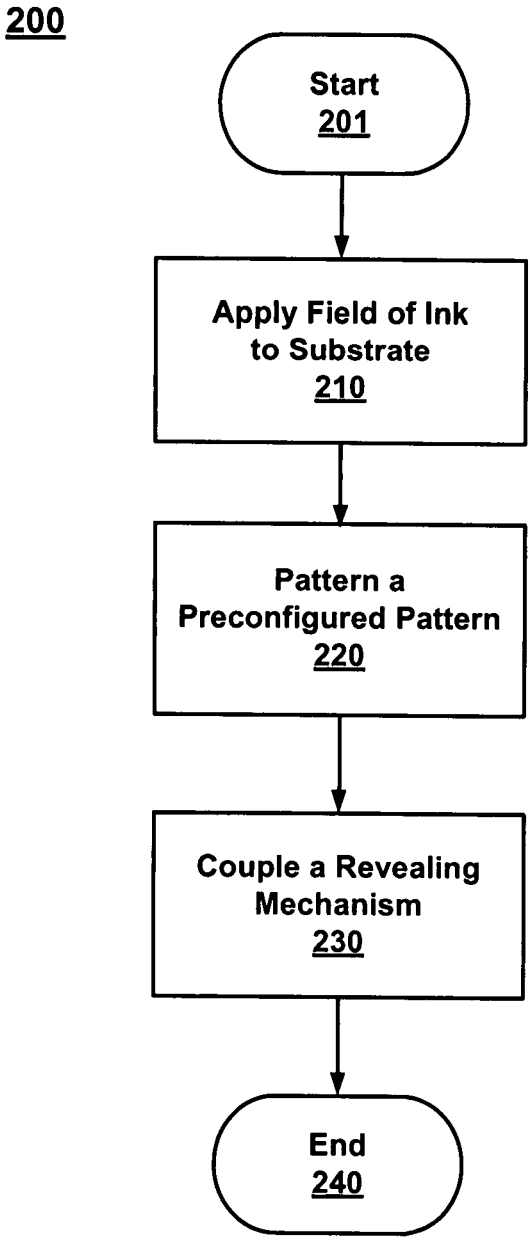
FIG. 2 is a flow chart illustrating a process for fabricating a covert label, in accordance with an embodiment of the present invention.

FIG. 2 is a flow chart illustrating a process 200 for fabricating a covert label, in accordance with an embodiment of the present invention. In one embodiment, process 200 is carried out by processors and electrical components under the control of computer readable and computer executable instructions. The computer readable and computer executable instructions reside, for example, in data storage features such as computer usable volatile and nonvolatile memory. However, the computer readable and computer executable instructions may reside in any type of computer readable medium. Although specific components are disclosed in process 200, such components are exemplary. That is, the embodiments of the present invention are well suited to performing various other components or variations of the components recited in FIG. 2. Within the present embodiment, it should be appreciated that the components of process 200 may be performed by software, by hardware, by an assembly mechanism, through human interaction, or by any combination of software, hardware, assembly mechanism, and human interaction.

Process 200 will be described with reference to elements shown in FIGS. 3A through 3C.

Figure 3:
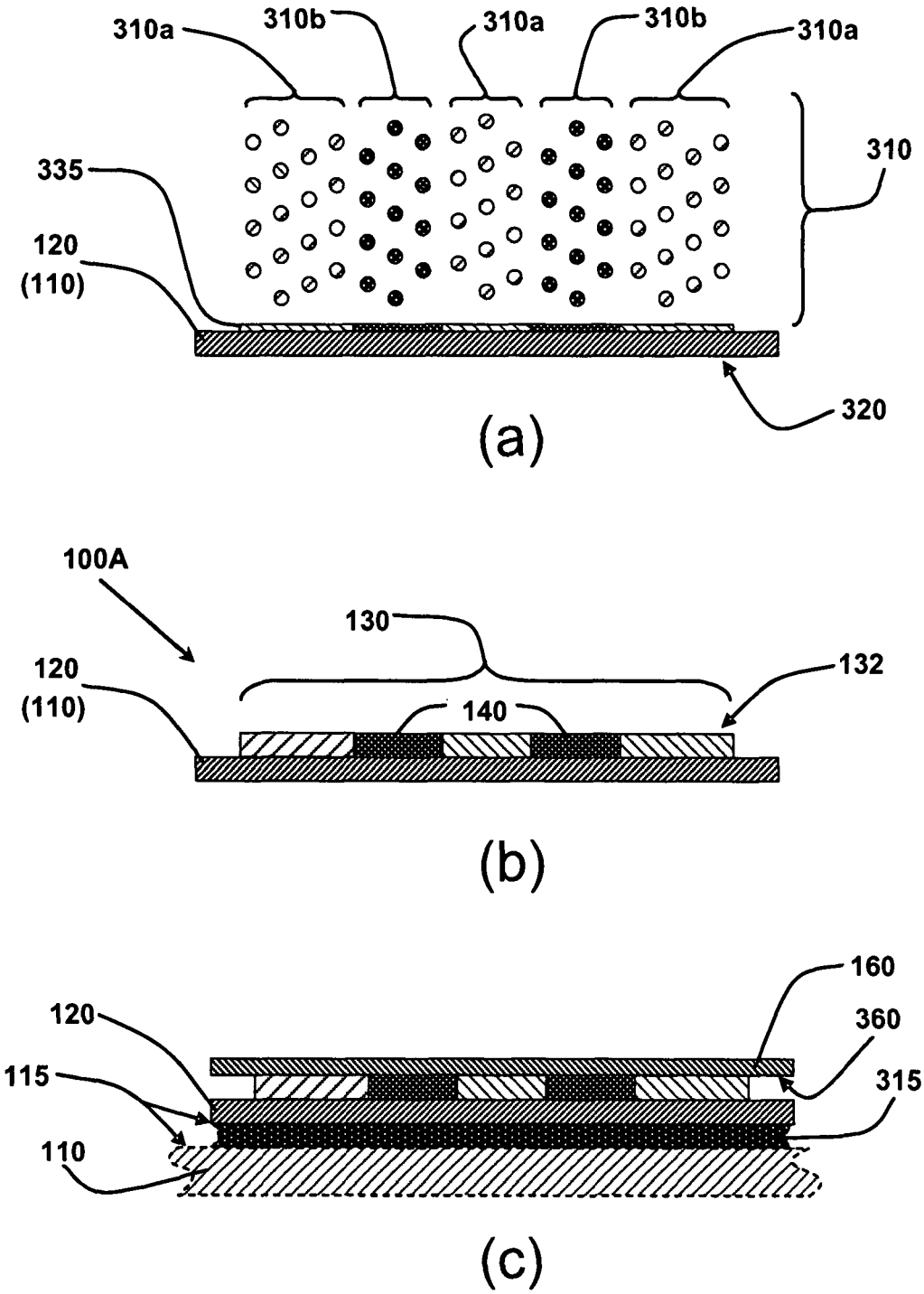
FIGS. 3A through 3C are cross-sections of a detail of a covert label at process components of fabrication in accordance with one embodiment of the present invention.

In one embodiment, as shown at 201 of process 200 and in FIG. 3A, substrate 120 is introduced into process 200. Process 200 is a printing environment in which ink and/or primer and/or adhesion inhibitor can be applied to substrate 120. In accordance with one embodiment, substrate 120 is a freestanding, unattached substrate that is separate from object 110, which will use covert label 100A. In accordance with another embodiment object 110, such as a package, is also substrate 120, which will receive ink 310.

In one embodiment, as shown at 210 of process 200 and in FIG. 3A and FIG. 3B, substrate 120 receives field of ink 130. Ink 310 prints field of ink 130 by means of differentially adhering ink (310*a*, 310*b*). Differential adhesion may be produced in a number of ways known to those schooled in the art of ink formulation and printing. For example, ink 310*b* can be formulated to swell more than ink 310*a*, thus resulting in ink 310*b* to have less adhesion than ink 310*a*. Differences in temperature and moisture content between ink 310*a* and 310*b* will result in differential adhesion between ink 310*a* and ink 310*b*.

In accordance with one embodiment, differential adhesion between ink 310*a* and ink 310*b* is achieved by applying adhesion layer 335 prior to applying ink 310. Adhesion layer 335 comprises a combination of adhesion promoter and/or adhesion inhibitor. By applying adhesion layer 335 in preconfigured pattern 140, prior to applying an ink having approximately consistent adhesion, a similar result is achieved as to applying ink 310 with differential adhesion ink (310*a*, 310*b*) in a similar preconfigured pattern 140.

In one embodiment, as shown at 220 of process 200 and in FIG. 3A and FIG. 3B, ink 310 is applied to substrate 120 in preconfigured pattern 140 comprised of adjacent and alternating applications of ink 310*a* and ink 310*b*. In another embodiment, preconfigured pattern 140 is printed in positive image with an adhesion promoter inside field of ink 130, prior to applying ink 310. In another embodiment, preconfigured pattern 140 is printed in negative image with an adhesion promoter inside field of ink 130, prior to applying ink 310. In another embodiment, preconfigured pattern 140 is printed in positive image with an adhesion inhibitor inside field of ink 130, prior to applying ink 310. In another embodiment, preconfigured pattern 140 is printed in negative image with an adhesion inhibitor inside field of ink 130, prior to applying ink 310.

In accordance with one embodiment of the present invention, field of ink 130 comprises one color. In another embodiment, field of ink 130 comprises a pattern or image wherein ink 310*a* and ink 310*b* are indistinguishable from the image or pattern. In so doing, preconfigured pattern 140 comprised of ink (310*a*, 310*b*) is invisible and unrevealed until differentially adhering ink (310*a*, 310*b*) is removed.

Preconfigured pattern 140 comprises information that can be associated to object 110, to which it can be coupled. Information (150, 151) concealed in preconfigured pattern 140 can be accessible by several techniques known in the industry for cross-referencing and associating data. For example, a bar code or machine recognizable character code imprinted on surface 320 of freestanding substrate 120 can be read prior to coupling covert label 100A to substrate 110. In the instance of substrate 120 being object 110, such as a package or end-user product, software routines that defines preconfigured pattern 140 associate information (150, 151) directly with object 110.

In accordance with an embodiment of the present invention, preconfigured pattern 140 can be printed with ink having adhesion less than adhesion of the surrounding ink within field of ink 130. In accordance with another embodiment of the present invention, preconfigured pattern 140 can be printed with ink having adhesion greater than adhesion of the surrounding ink within field of ink 130.

In one embodiment, as shown at 230 of process 200 and in FIG. 3B and FIG. 3C, ink removal mechanism 160 is coupled to covert label 100A via surface 132 and surface 360. Several revealing mechanisms performing the function of ink removal mechanism 160 are available for coupling to cover label 100A. All revealing mechanisms operable to removing ink and revealing information (150, 151) (FIG. 1B) have the characteristic of adhesively coupling to surface 132 of covert label 100A.

In one embodiment, wherein substrate 120 is object 110, ink removal mechanism 160 is a translucent and/or transparent membrane, such as adhesive tape that is adhered to field of ink 130 after covert label 100A is coupled to object 110. In another embodiment, wherein substrate 120 is freestanding, ink removal mechanism 160 is translucent and/or transparent membrane, such as adhesive tape that is adhered to field of ink 130 before covert label 100A is coupled to object 110. In another embodiment, wherein substrate 120 is freestanding or is object 110, ink removal mechanism 160 is a translucent and/or transparent membrane adhered to surface 132 before field of ink 130 is dry. Wherein covert label 100A is freestanding, in accordance with another embodiment of the present invention, substrate 120 is transparent and/or translucent and surface 132 is adhered to object 110.

In one embodiment, as shown at 240 of process 200 and in FIG. 3B and FIG. 3C, fabrication of covert label 100A is complete. In accordance with embodiments of the present invention, covert label 100A is operable for attaching to object 110 via adhesive 315 coupled to interface 115, or operable for coupling to object 110 via surface 132.

Figure 4:
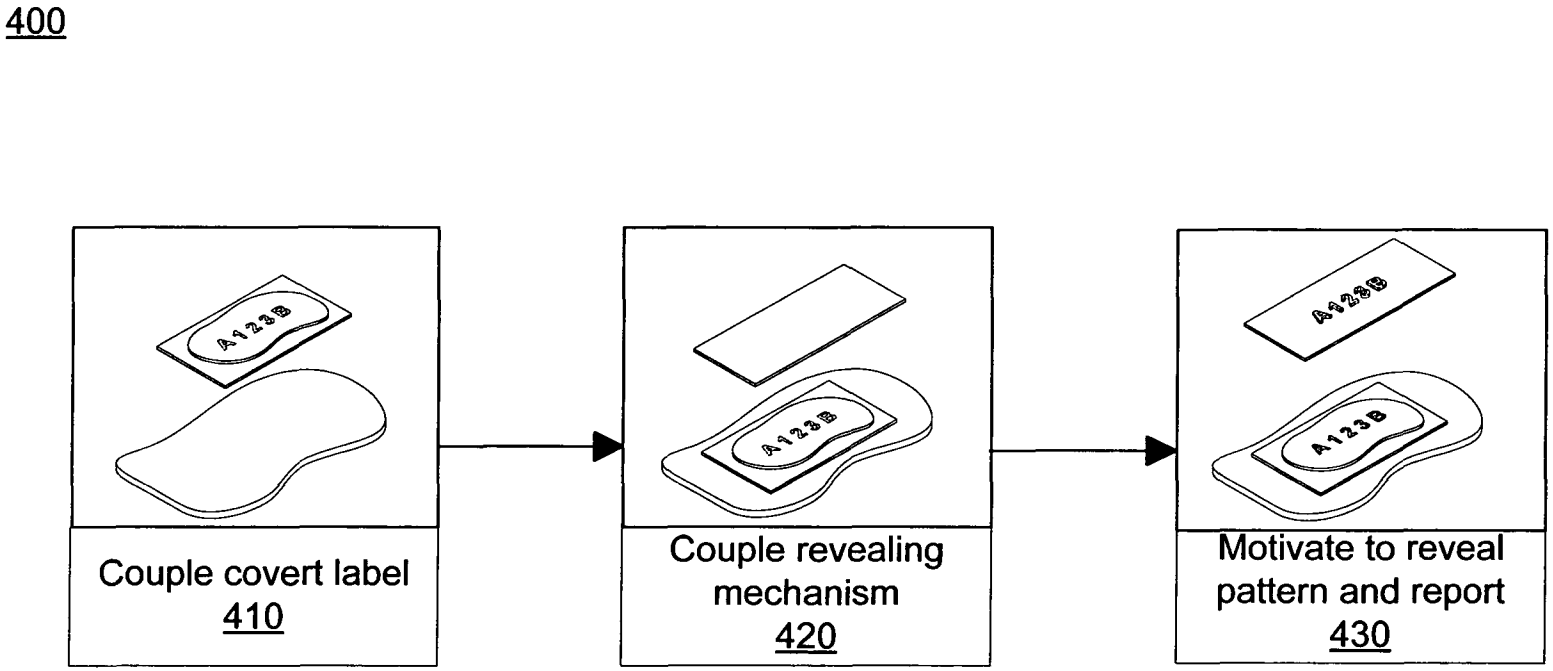
FIG. 4 is block diagram illustrating a method for implementing a covert label, in accordance with an embodiment of the present invention.

FIG. 4 is block diagram illustrating a method for implementing a covert label for tracking an object via information comprised within a preconfigured pattern to a database, in accordance with an embodiment of the present invention. Method 400 includes: coupling a covert label to an object; coupling a revealing mechanism to the covert label; and presenting incentive to activate the revealing mechanism and report a revealed preconfigured pattern to a database. It should be appreciated that method 400 can be implemented as software, hardware, firmware, or any combination thereof. Moreover, it should be appreciated that method 400 may include additional components that are not shown so as to not unnecessarily obscure aspects of the embodiments of the present invention.

Method 400 will be described with reference to elements shown in FIGS. 3A through 3C.

In accordance with an embodiment of the present invention and with reference to FIG. 3C, element 410, couple covert label, of method 400 is effected by several means. Embodiments of the present invention provide adhesive layer 315 applied to interface 115 between object 110 and substrate 120. Adhesive layer 315 is applied as a film between substrate 120 and object 110. Adhesive layer 315 is introduced to interface 115 adhered to substrate 120, and/or introduced to interface 115 adhered to object 110. In accordance with another embodiment and with reference to FIG. 3*b*, object 110 is substrate 120 and field of ink 130 is applied to object 110, such as in the case of a preprinted package.

In accordance with an embodiment of the present invention and with reference to FIGS. 3A through 3C, element 420, couple revealing mechanism, of method 400 is effected by several means. Embodiments of the present invention provide ink removal mechanism 160 whereby ink removal mechanism 160 comprises a translucent and/or transparent membrane coupled to surface 132 of field of ink 130. In accordance with other embodiments, ink removal mechanism 160 is coupled to covert label 100A before or after covert label 100A is coupled to object 100A. In accordance with another embodiment of the present invention, covert label 100A is adhesively coupled to object 110 via an adhesive layer applied to surface 132. Substrate 120 is transparent and/or translucent. In accordance with another embodiment, ink removal mechanism 160 is applied to surface 132 before field of ink 130 has dried.

Embodiments of ink removal mechanism 160 of element 420 are operable to irreversibly revealing preconfigured pattern 140. Irreversible revealing of preconfigured pattern 140 is effected in accordance with embodiments of the present invention by removing differentially adhering ink (310*a*, 310*b*) from field of ink 130. With reference to FIG. 1B, once ink removal mechanism 160 has been activated and information 150 and reverse image information 151 have been revealed, it is very difficult to couple information 150 and reverse image information 151 to each other so as to not reveal preconfigured pattern 140. Several factors that add to the difficulty are: much care and dexterity are required, possibly under a microscope; ink removal mechanism 160 may stretch and distort during the revealing process; adhesion between ink removal mechanism 160 and field of ink 130 may not be recoverable. Any exposure of preconfigured pattern 140 can be an indication of tampering with covert label 100A and the validity of the object to which it is attached is suspect.

In accordance with an embodiment of the present invention and with reference to FIG. 3B and FIG. 3C, element 430, motivate to reveal pattern and report, is effected by several means. In accordance with an embodiment of the present invention, coupling covert label 100A to object 110 so as to prevent use or operation of object 110 will present an incentive and motivation to activate ink removal mechanism 160. With reference to FIG. 1A and FIG. 1B, and in accordance with other embodiments of the present invention, remuneration for reporting revealed information (150, 151) is offered on object 110 and/or in information (150, 151) and/or on covert label 100A, and/or on overt label 100B.

In one embodiment, reporting information (150, 151) to a database comprises entry of information (150, 151) at point of sale of object 110, which is coupled to overt label 100B, for example by means of a bar code scanner or character recognition system. In another embodiment, reporting information (150, 151) to a database comprises entry of information (150, 151) by end-user of object 110, which is coupled to overt label 100B, by means of the Internet. In another embodiment, reporting information (150, 151) to a database comprises entry of information (150, 151) by end-user of object 110, which is coupled to overt label 100B, by means of a postal system.

The present invention, in the various presented embodiments allows for a covert label having a preconfigured pattern comprising information that can be associated to at least one object. By coupling the covert label and a revealing mechanism to the object, and presenting an incentive to reveal and report the information to a database, fraudulent use of an object can be deterred. An object such as a product, package, or consumer good can be protected against fraudulent reselling, reuse and/or counterfeiting. In so reporting the information to a database, a producer can gain information into the demographics of the end-users of their product, while protecting their product from fraudulent use.

The foregoing descriptions of specific embodiments of the present invention have been presented for purposes of illustration and description. They are not intended to be exhaustive or to limit the invention to the precise forms disclosed, and many modifications and variations are possible in light of the above teaching. The embodiments described herein were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A covert label comprising:

a substrate;

a field of ink applied onto said substrate;

ink disposed within said field of ink, wherein said ink is operable to preferential removal according to a preconfigured pattern, wherein said preconfigured pattern is unrevealed, comprises an incentive and comprises information associable with at least one object; and an ink removal mechanism disposed over said field of ink and comprising an adhesive surface coupled with said ink, wherein activation of said ink removal mechanism reveals said preconfigured pattern such that said preconfigured pattern is unrevealed until activation of said ink removal mechanism, wherein said activation allows said at least one object to be operable, wherein said preconfigured pattern comprises ink having adhesion to said substrate different than adhesion of surrounding ink within said field of ink, and wherein one of:

said ink of said preconfigured pattern swells more than said surrounding ink and has less adhesion than said surrounding ink;

an adhesion promotion primer is applied to said substrate according to said preconfigured pattern prior to application of said field of ink, said ink of said preconfigured pattern resultantly having more adhesion than said surrounding ink.

2. The covert label of claim 1 wherein said preconfigured pattern is irreversibly revealed upon activation of said mechanism.

3. The covert label of claim 2 wherein said ink removal mechanism is coupled to said covert upon assembly of said object.

4. The covert label of claim 1 wherein said substrate is adhesively coupled to said object.

5. The covert label of claim 1 wherein said object comprises said substrate.

6. The covert label of claim 1 wherein said object comprises said a package.

7. The covert label of claim 1 wherein said ink of said preconfigured pattern is of an ink type swelling more than and having less adhesion than a different ink type of said surrounding ink.

8. The covert label of claim 1 further comprising said adhesion promotion primer.

9. A method of fabricating a covert label, said method comprising:

applying a field of ink onto a substrate, wherein ink disposed within said field of ink is operable to preferential removal according to a preconfigured pattern, wherein said preconfigured pattern is unrevealed and which invisibly identifies an object, and wherein said preconfigured pattern comprises an incentive and information that is distinct to said object; and coupling a revealing mechanism which is operable to irreversibly reveal said preconfigured pattern upon activation of said revealing mechanism, such that said preconfigured pattern is unrevealed until activation of said revealing mechanism, wherein said activation allows said at least one object to be operable such that without activation said object is not operable, wherein said preconfigured pattern comprises ink having adhesion to said substrate different than adhesion of surrounding ink within said field of ink, and wherein one of:

said ink of said preconfigured pattern swells more than said surrounding ink and has less adhesion than said surrounding ink;

an adhesion promotion primer is applied to said substrate according to said preconfigured pattern prior to application of said field of ink, said ink of said preconfigured pattern resultantly having more adhesion than said surrounding ink.

10. A method of claim 9 wherein said coupling a revealing mechanism comprises adhering a translucent membrane to said field of ink prior to coupling said covert label to an object.

11. A method of claim 9 wherein said coupling a revealing mechanism comprises adhering a translucent membrane to said field of ink after coupling said covert label to an object.

12. The method of claim 9 wherein said applying said field of ink onto said substrate comprises:

applying said ink of said preconfigured pattern using a first ink type; and applying said surrounding ink using a second ink type, wherein said first type ink swells more than and less adhesion than said second ink type.

13. A method of claim 9 further comprising applying said adhesion promotion primer to said substrate according to said preconfigured pattern prior to application of said field of ink.

14. A method comprising: coupling a covert label to an object that is an end-user product, the covert label comprising a substrate, a field of ink applied onto the substrate, and ink disposed within the field of ink, wherein the ink is operable to preferential removal according to a preconfigured pattern, wherein the preconfigured pattern is unrevealed, comprises an incentive and comprises information associated with the object; coupling a revealing mechanism to the covert label, the revealing mechanism disposed over the field of ink and comprising an adhesive surface coupled with the ink, wherein activation of the revealing mechanism reveals the preconfigured pattern such that the preconfigured pattern is unrevealed until activation of the ink removal mechanism; and presenting the incentive to activate the revealing mechanism and for reporting information comprised within the preconfigured pattern to a database once the preconfigured pattern is revealed, wherein the preconfigured pattern comprises ink having adhesion to the substrate different than adhesion of surrounding ink within the field of ink, and wherein one of: the ink of the preconfigured pattern swells more than the surrounding ink and less adhesion than the surrounding ink; an adhesion promotion primer is applied to the substrate according to the preconfigured pattern prior to application of the field of ink, the ink of the preconfigured pattern resultantly having more adhesion than the surrounding ink.

15. A method of claim 14 wherein said presenting an incentive comprises:

offering remuneration for activating said revealing mechanism, and reporting said information comprised within said preconfigured pattern to said database.

16. A method of claim 14 wherein said presenting an incentive comprises:

inhibiting operation of said object while said revealing mechanism is not activated, where upon activation of said revealing mechanism, operation of object is allowed and remuneration is offered for reporting said information comprised within said preconfigured pattern to said database.

* * * * *